United States Patent [19]

Carson, Jr. et al.

[11] 4,162,131

[45] Jul. 24, 1979

[54] DRIVE CIRCUIT FOR PRINTING HEAD

[75] Inventors: Andrew B. Carson, Jr., Waynesboro; Michael J. Tuso, Afton, both of Va.

[73] Assignee: General Electric Company, Waynesboro, Va.

[21] Appl. No.: 847,853

[22] Filed: Nov. 2, 1977

[51] Int. Cl.[2] ..... B41J 3/12

[52] U.S. Cl. ..... 400/124; 101/93.03; 361/152; 400/166

[58] Field of Search ..... 101/93.02–93.05; 318/126; 361/152–154; 400/124, 157.3, 166, 167

[56] References Cited

U.S. PATENT DOCUMENTS

| | | | |
|---|---|---|---|
| 3,456,161 | 7/1969 | Soltis | 361/152 |
| 3,711,754 | 1/1973 | Nemoto | 318/126 |
| 3,789,272 | 1/1974 | Vollhardt | 361/154 |
| 3,866,533 | 2/1975 | Gilbert et al. | 101/93.14 |
| 3,904,010 | 9/1975 | Krauss et al. | 101/93.05 X |
| 3,921,517 | 11/1975 | Barcomb et al. | 101/93.09 |
| 3,991,869 | 11/1976 | Berrey | 335/276 X |
| 3,994,381 | 11/1976 | Hebert | 400/124 |
| 4,024,506 | 5/1977 | Spaargaren | 400/124 X |
| 4,027,761 | 6/1977 | Quaif | 400/124 |
| 4,079,824 | 3/1978 | Ku | 400/124 |

*Primary Examiner*—Paul T. Sewell
*Attorney, Agent, or Firm*—Michael Masnik

[57] ABSTRACT

A drive circuit is responsive to input pulses to supply drive energy pulses to the printing head of a matrix printer so as to produce constant impact forces and constant print intensity over a wide range of print rates by decreasing the energy of the drive pulses as a function of the time interval between successive input pulses as said interval diminishes below a predetermined value. In one embodiment the amplitude of the drive pulses is reduced as the frequency of the input pulses exceeds the predetermined value. In a second embodiment the duration of the drive pulses is reduced as the frequency of the input pulses exceeds the predetermined value.

13 Claims, 7 Drawing Figures

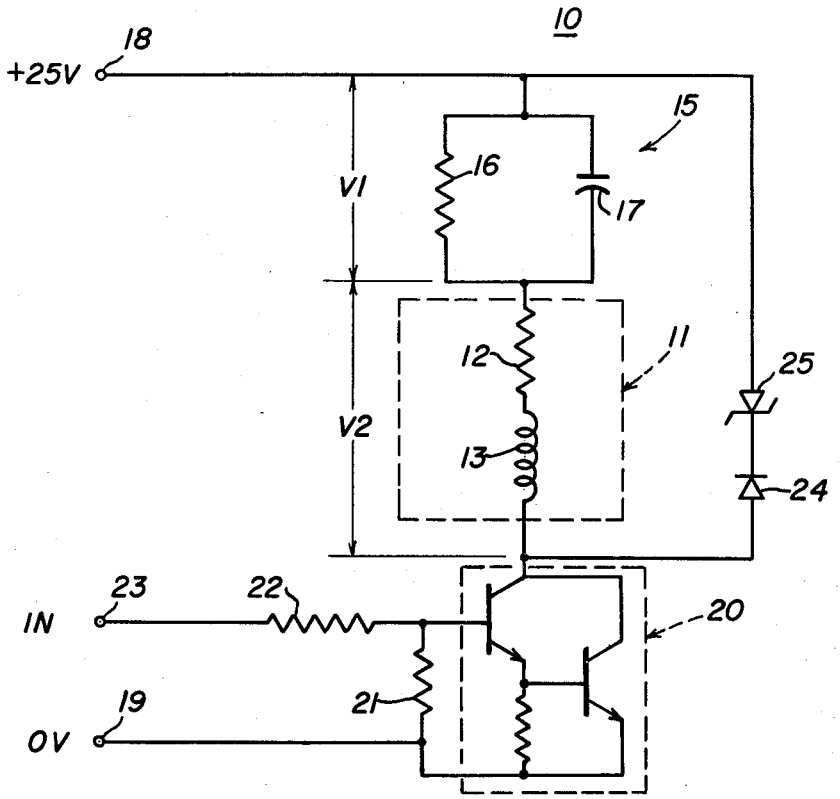
FIG. 3
FIG. 4
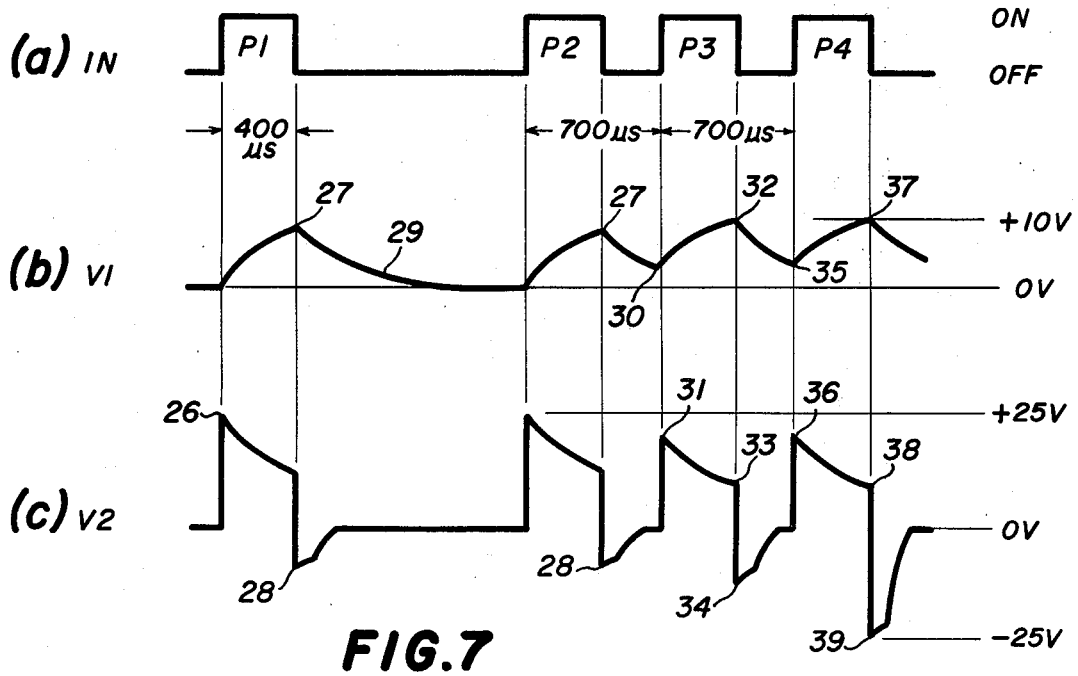
FIG. 7
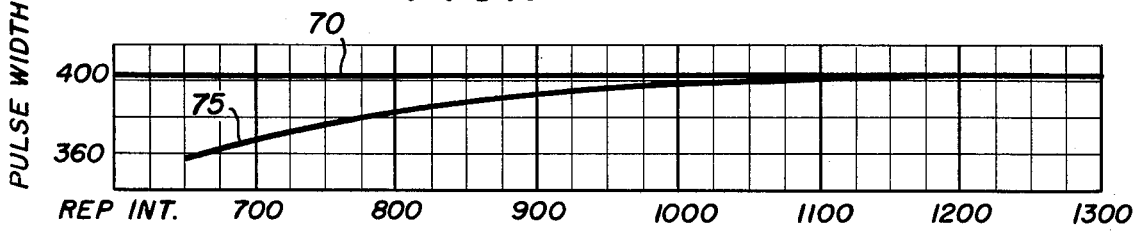

DRIVE CIRCUIT FOR PRINTING HEAD

BACKGROUND OF THE INVENTION AND PRIOR ART STATEMENT

The present invention relates to the control of printing heads, and particularly for impact printers, such as dot matrix printers operating at very high data rates, to insure uniformly good quality printing.

A fairly common type of printer is a dot matrix printer. This type of printer involves a plurality of print wires or styli which are arranged in one or more vertical lines and are maintained in a spaced-apart arrangement in a print head. The head is supported on a carriage which in turn is caused to traverse a line of movement across a record medium. A common type of dot pattern involves a 5×7 matrix. As the carriage shifts the print head through the successive columns across a line of movement on the record medium, a 5×7 dot pattern of alphanumeric characters or symbols is produced on the record medium by selectively displacing or extending the individual print wires in their successive column positions to impact the record medium through an inked ribbon.

Each print wire or stylus typically has a drive circuit for controlling the operation thereof. Signals from an associated source such as a keyboard are fed to a matrix encoder which converts them to signals of the matrix format for controlling the print wire drive circuits. The drive circuits usually attempt to supply constant energy drive pulses, based upon the assumption that constant energy drive pulses always produce constant impact forces and uniform print intensity.

It has been found, however, that this assumption is incorrect when an electromagnetic print head element operates at or near a maximum repetition rate established by the dynamics of its spring-mass system where this rate exceeds the response capability of the electromagnetic system involved. More particularly, as the repetition rate at which the print wires are operated is increased beyond a predetermined threshold rate, a condition is arrived at wherein there is insufficient time between adjacent drive pulses to permit complete decay of the magnetic field in the print head. Thus, at the initiation of the next driving pulse, some magnetic energy from the previous pulse remains in the print head. Consequently, if equal energy is used for all driving pulses, this energy will be added to the residual energy left from the preceding pulse and will cause the print wires to print harder at printing rates approaching the maximum print rate than they do at lower printing rates which permit sufficient time for a complete decay of the magnetic energy of the print head between driving pulses.

This uneven printing which occurs when the print head is operating at or near its maximum designed rate presents a significant problem since it has been found that, depending on the data pattern, approximately 35 percent of the printed dots in a typical text require maximum rate response of the print head. In addition to uneven printing, the excessive forces resulting from overdriving of the fast-rate dots can result in ribbon damage as well as overheating and/or excessive wear of the print head. Furthermore, when rapidly printed dots are overdriven, the print wires may impact and try to return to their rest positions before the magnetic fields driving them start to decay. The residual magnetic field may oppose the return movement of the print wires, thereby limiting print rate and introducing undesirable effects, such as variation in dot spacing and skipped dots.

Nor it is practicable to reduce the energy of all of the drive pulses to a level which will produce the proper print intensity for high-rate pulses, since this energy level will be insufficient to produce adequate print intensity of pulses printed at lower rates. Therefore, a means for producing uniform print intensity at all print rates is clearly needed.

U.S. Pat. No. 3,866,533, which issued to R. L. Gilbert et al. on Feb. 18, 1975, discloses means for changing the width of drive pulses applied to the print hammers of a high-speed printer to compensate for variations in the source voltage and variation in the thickness of the record medium being imprinted.

U.S. Pat. No. 3,172,353, which issued to C. J. Helms on Mar. 9, 1965, discloses means for extending the length of the drive pulses beyond the time at which the print hammer strikes the record medium so that the print head magnetic field will oppose the print hammer rebound and thereby dissipate a portion of the rebound energy so as to minimize backstop wear.

Neither of these prior art patents discloses a matrix printer, but rather each discloses a printer of the type in which each print hammer prints a complete character. Therefore, the maximum repetitive impact rates in these prior art patents is inherently considerably less than that of a matrix printer wherein a plurality of repetitive print wire strokes are required to print most characters. The aforementioned prior art patents are therefore not concerned with uneven print intensity resulting from accommodating a wide range of print rates involving incomplete magnetic field decay between successive impulses.

SUMMARY OF THE INVENTION

The present invention relates to a matrix printer and, more particularly, to means for providing drive energy pulses for the printing head of a matrix printer so as to achieve uniform print wire impact force and print intensity at all print rates.

Another object of this invention is to provide an improved matrix printer.

More particularly, it is an object of this invention to provide a drive circuit for a matrix printer which provides uniform print intensity for all dots while avoiding overdriving of the print head.

Another object of this invention is the provision of a drive circuit of the character described which achieves improved print rate capability and extended print head life.

Another object of this invention is the provision of a drive circuit of the type set forth which is characterized by decreased energy requirements at high print rates.

In summary, there is provided a drive circuit responsive to a series of input pulses to provide drive pulses for the print wires of a printing head of a matrix printer, the drive circuit comprising electronic control means in circuit with a source of electrical energy and the printing head, said control means responsive to said input pulses for providing corresponding energy drive pulses to said printing head, insuring that said drive pulses applied to said head result in said print wires producing essentially constant impact forces during printing comprising circuit means responsive to the time interval between successive pulses being less than a predetermined value for progressively reducing the energy of the drive pulses provided to said printing head as a function of said time interval.

Further features of the invention pertain to the particular arrangement of the parts of the drive circuit whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 3 is a schematic circuit diagram of a printing head drive circuit constructed in accordance with and embodying the features of a first embodiment of the present invention, for supplying constant width, variable amplitude drive pulses to the printing head;

FIGS. 4(*a*)–4(*c*) are voltage waveforms at various portions of the circuit of FIG. 3;

FIG. 7 is a plot of drive pulse width versus input pulse repetition interval for the drive circuit of FIG. 5.

DESCRIPTION OF THE PREFERRED EMBODIMENTS

Figure 1:
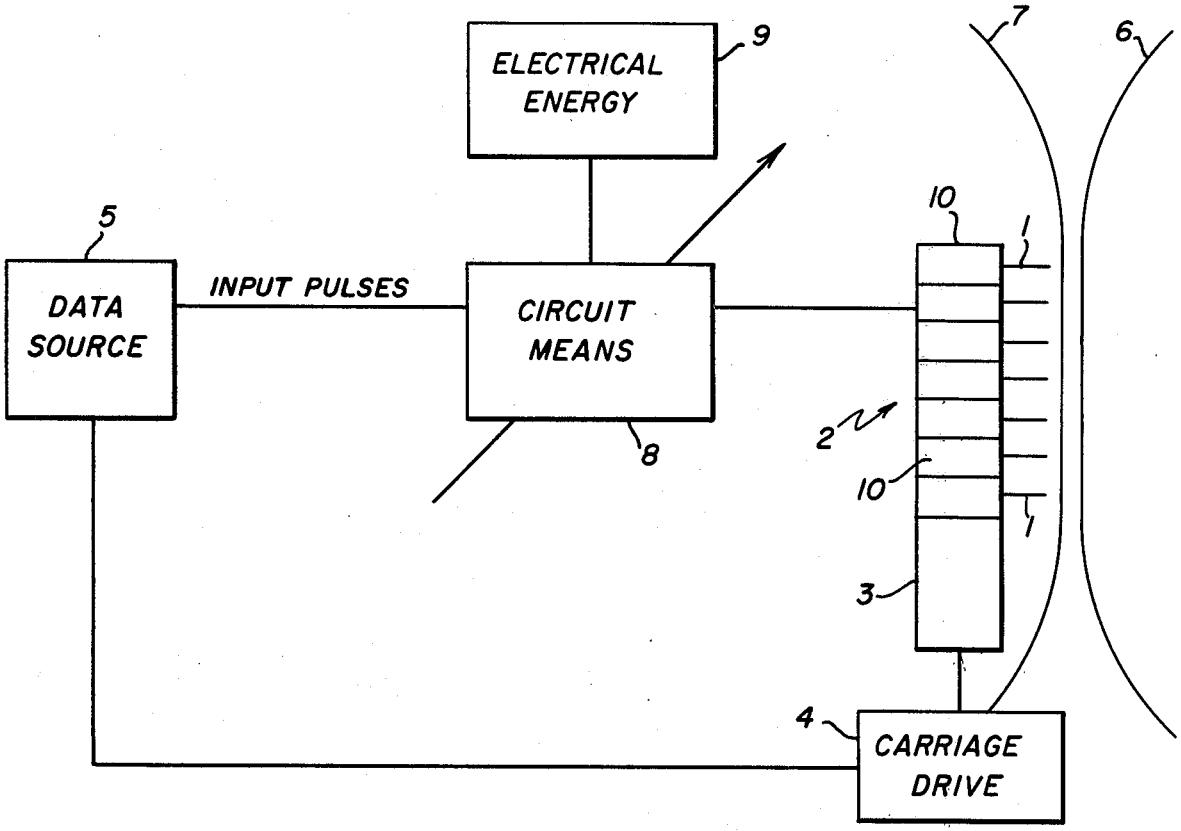
FIG. 1 illustrates the invention in block diagram form.

As previously mentioned, matrix printers involving print wires or styli are well known in the art. Printing takes place upon styli impact against a record medium. A fairly common type shown in FIG. 1 involves a plurality of print wires 1 or styli which are arranged in a vertical line. These wires are maintained in a spaced apart arrangement in a print head 2. The head is supported on a carriage 3 which in turn is caused by drive 4 to traverse a line of movement across a record medium such as paper in response to control signals from a data source 5. A common type of dot pattern involves a 5×7 matrix. If the carriage moves the print head through successive columns across a line of movement on the record medium, a 5×7 dot pattern of characters or symbols is produced on the record medium by selective displacement or extension of the individual print wires in their successive column positions for impacting the record medium through an inked ribbon. FIG. 1 shows schematically a carriage 3 carrying a print head 2 housing an array of print wires 1 normally in a nondisplaced position. Data from a source 5 controls the drive mechanism 4 for moving the carriage across a line on the record medium 6 in both directions in front of an ink ribbon 7. Data source 5 also provides input pulses defining the symbols to be printed for successive column positions of the carriage during its movement across the record medium. Circuit means 8 coupled to electrical energy source 9 selectively provides drive energy pulses to the electromagnetic actuating means 10 associated with each print wire 1 to selectively displace the desired print wires in head 2 for causing a dot to be imprinted on record medium 6 by ribbon 7. Thus for printing the letter L, for example, all of the wires in the vertical array would be simultaneously actuated in response to input pulses to cause printing of the first portion of the symbol L. Thereafter only one of the styli would be successively actuated for the remaining four interdot positions to complete the character.

Figure 2:
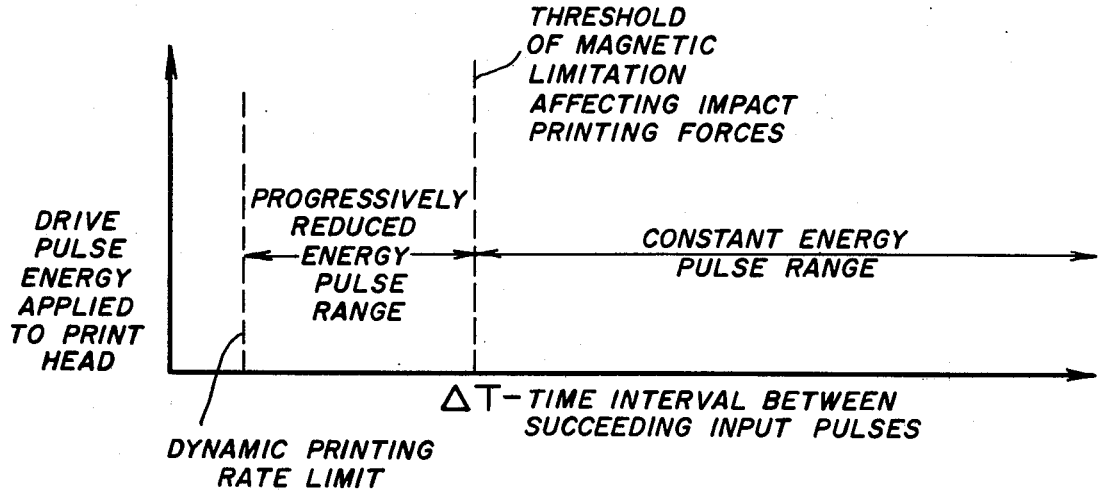
FIG. 2 illustrates graphically certain principles of the present invention.

FIG. 2 illustrates some of the principles of the present invention. As previously mentioned the maximum printing rate of a printer is limited by the dynamics of the printer design and by the magnetic circuitry employed to effect printing by the styli. If the printing rate is dynamically optimized for speed of printing by proper attention to spring mass, friction, mechanical linkages and damping, etc. then the magnetic design usually becomes the primary print rate limitation. This arises because of the finite time required for the eddy currents and other phenomena of the magnetic circuits to decay. FIG. 2 illustrates where the value of drive pulse energy is modified for various values of the time interval between succeeding input pulses is. The threshold of magnetic limitation defines the region at which the continued application of constant energy pulses by the print wire driving circuits results in uneven and undesirable printing. The dynamic printing rate limit defines the region where printing can no longer be usefully performed due to mechanical limitations. Between these two regions, improved printing can take place in accordance with the present invention, by progressively reducing the drive energy pulses as a function of the time interval between successive input pulses.

Referring now to FIG. 3 of the drawings, there is illustrated a drive circuit, generally designated by the numeral 10, for supplying constant width, variable amplitude drive pulses to the printing head 11 of a dot matrix printer, the printing head 11 being represented by the equivalent circuit comprising a resistance 12 and the inductance 13 connected in series. While only a single resistance-inductance combination is illustrated in the printing head 11, it will be appreciated that, in practice, the printing head 11 includes a plurality of print wires or styli which are spaced apart in a vertical line, and each of which is connected to a driving electromagnet. Thus, a drive circuit 10 will be provided for each of the several electromagnets in the printing head 11 which may, for example, be of the type illustrated in U.S. Pat. No. 3,991,869, issued on Nov. 16, 1976 to H. R. Berrey, and assigned to the assignee of the present invention.

The printing head 11 is connected in series with a print rate compensation network, generally designated by the numeral 15, and comprising the parallel combination of a resistor 16 and a capacitor 17. More particularly, one terminal of the print head 11 is connected to one junction between the resistor 16 and capacitor 17, while the other junction therebetween is connected to one terminal 18 of an associated voltage source, the other terminal 19 of which is connected to the emitter of a transistor 20, the collector of which is connected to the other terminal of the printing head 11. A resistor 21 is connected across the base-emitter junction of the transistor 20, the base of which is also connected by a resistor 22 to a pulse input terminal 23. The series combination of a diode rectifier 24 and Zener diode 25 is connected between the terminal 18 and the collector of the transistor 20 to protect the transistor 20 from the inductive load presented by the printing head 11 during turnoff.

Referring now also to FIGS. 4(*a*)–4(*c*) of the drawings, the operation of the drive circuit 10 will be described. FIG. 4(*a*) shows the voltage waveform of the input pulses arriving at the input terminal 23 from an associated matrix encoder. The pulses P1 and P2 represent input pulses arriving at a low print rate, while the pulses P3 and P4 represent input pulses arriving at a high print rate. FIG. 4(*b*) illustrates the waveform of the voltage V1 across the print rate compensation network 15, while FIG. 4(*c*) illustrates the waveform of the voltage V2 across the printing head 11. In all instances, voltage in volts is plotted as the ordinate and time in microseconds is plotted as the abscissa.

Normally, the transistor 20 is held off, thereby open-circuiting the printing head 11. When the first input pulse P1 of a series of low-rate pulses arrives at the input terminal 23, it is transmitted to the base of the transistor 20, thereby turning it on and permitting energization of the printing head 11. In one embodiment, the terminals 18 and 19 of the associated voltage source were normally at +25 VDC and 0 VDC, respectively, and when the leading edge of the input pulse P1 arrives at the base of the transistor 20, this full 25 volts immediately appears across the printing head 11, as indicated at point 26 in FIG. 2(*c*).

During the input pulse P1, the sum of the voltages V1 and V2 across the print rate compensation network 15 and the printing head 11 are always equal to the supply voltage of 25 volts. Thus, during the input pulse P1, the capacitor 17 charges to a point 27, while the voltage V2 across the printing head 11 simultaneously reduces at the same rate so that the sum of V1 and V2 remains substantially constant. At the end of the input pulse P1, the voltage V2 instantaneously drops to a negative value at point 28, while the voltage V1 across the print rate compensation network 15 decays as at 29 while the capacitor 17 discharges through the resistor 16.

The time constant of the print rate compensation network 15 is such that, at low print rates, the interval between the first input pulse P1 and the next input pulse P2 is sufficient to allow the voltage V1 to decay to zero. During the next input pulse P2, the waveforms of the voltages V1 and V2 are the same as they were for the input pulse P1. Thus, the voltage V2 across the printing head 11 forms a series of equal energy drive pulses at low print rates.

At print rates approaching the maximum print rate of the dot matrix printer, the input pulses P3 and P4 arrive at closer intervals. Considering input pulse P2 as the first of a series of high-rate pulses, during the input pulse P2, the voltages V1 and V2 have the same waveforms as were described above in connection with the low printing rate. At the end of the input pulse P2, the voltage V1 begins to decay in the same manner as was described above, but before it can decay to 0, the next input pulse P3 arrives, causing the capacitor 17 to again begin to charge. But this time, instead of charging from a 0 VDC level, the capacitor 17 begins to charge from a positive voltage level at point 30. Since the sum of the voltages V1 and V2 must remain 25 volts, the voltage V2 across the printing head 11 will be less than 25 volts at the beginning of the input pulse P3, as indicated at 31.

During the input pulse P3, the capacitor 17 will charge at the same rate as it did during the input pulse P2, and since it started recharging at a positive voltage level, it will charge to a voltage level of the point 32 which is higher than the charge reached at the point 27. Thus, the voltage V2 across the printing head 11 will have reduced during the input pulse P3 to a level at the point 33 less than that at the end of the input pulse P2 and will then instantaneously drop to a negative voltage level at the point 34 below that at the point 28.

Accordingly, the average level of the voltage V2 during the input pulse P3 is less than that during the input pulse P2, resulting in less energy being supplied to the printing head 11. But this reduced amount of supplied energy during the input pulse P3, when added to the residual energy remaining in the printing head 11 as a result of the incomplete decay of the magnetic forces between the input pulses P2 and P3, results in the printing elements being driven with the same energy during input pulse P3 as during input pulse P2 for producing the same impact force and print intensity.

In like manner, at the end of the input pulse P3, the voltage V1 begins to decay to the level at point 35, whereupon the next input pulse P4 arrives, causing the capacitor 17 to again charge to the point 37 while the voltage V2 reduces to the point 38.

In a constructional model of the drive circuit 10, the circuit elements have the following values: resistance 12 is 2 ohms.; inductance 13 is 1.6 mh.; resistor 16 is 10 ohms.; capacitor 17 is 100 μF.; resistor 21 is 1000 ohms.; and resistor 22 is 330 ohms. Diode rectifier 24 is a 1 amp. rectifier while Zener diode 25 is rated at 15 volts. The transistor 20 may be a General Electric D44E2, sometimes referred to as a Darlington transistor.

Figure 5:
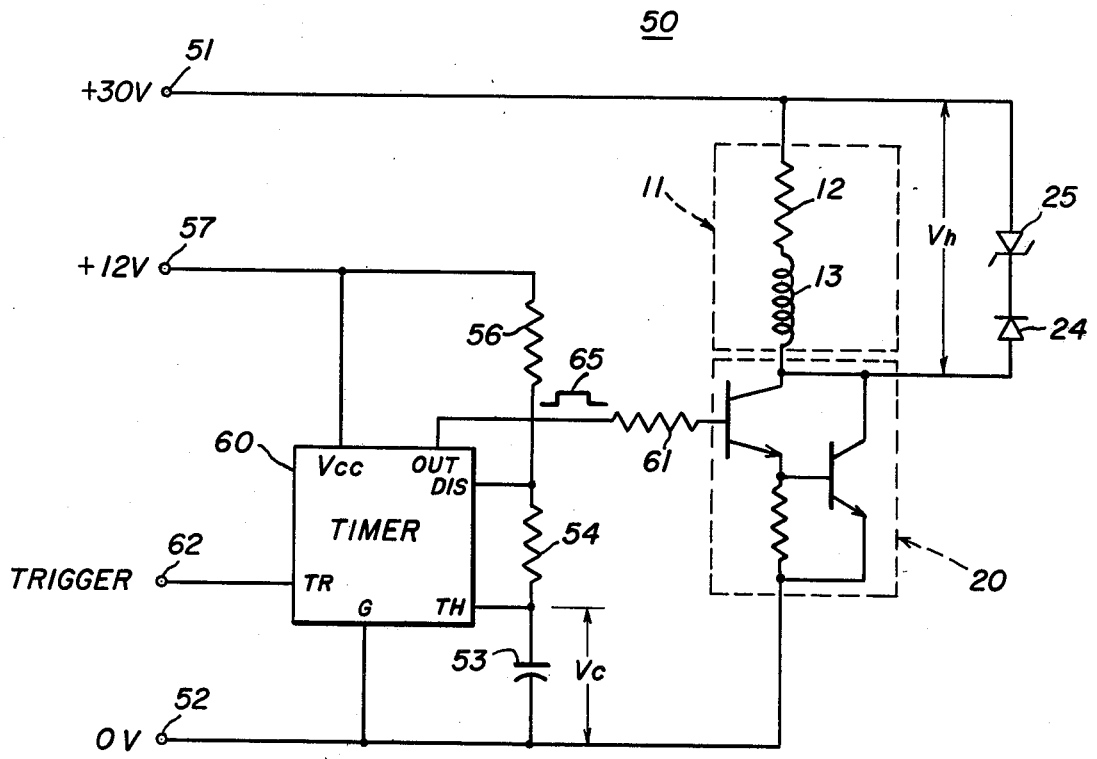
FIG. 5 is a schematic circuit diagram of a drive circuit constructed in accordance with and embodying the features of a second embodiment of the present invention for supplying constant amplitude, variable width drive pulses to the printing head.

Referring now to FIG. 5 of the drawings, there is illustrated another embodiment of a drive circuit, generally designated by the numeral 50, constructed in accordance with the present invention for supplying constant amplitude, variable width drive pulses to the printing head 11. The printing head 11 is connected to the collector of the transistor 20, which collector is also connected by the series combination of the diode rectifier 24 and Zener diode 25 to the positive terminal 51 of an associated head power supply, with the emitter of the transistor 20 being connected to the other terminal 52 of the power supply, in the same manner as was described above in connection with the embodiment of FIG. 3. However, in the drive circuit 50, the power supply terminal 51 is shown, in one embodiment, as being at +30 VDC.

The drive circuit 50 includes an RC network, generally designated by the numeral 55 and an integrated timing circuit 60, which is preferably of the type commonly known as a "555 timer" circuit. The network 55 includes the series combination of a capacitor 53 and resistors 54 and 56, with the capacitor 53 being connected to the power supply terminal 52 and the resistor 56 being connected to the terminal 57 of a +12 VDC control power supply. The timing circuit 60 has a supply voltage terminal $V_{cc}$ connected to the +12 VDC supply, a ground terminal G connected to the power supply terminal 52, a discharge terminal DIS connected to the junction between the resistors 54 and 56 and a threshold terminal TH connected to the junction between the resistor 54 and the capacitor 53. The timing circuit 60 also includes an output terminal OUT connected via a resistor 61 to the base of the transistor 20, and a trigger terminal TR connected to a terminal 62 of an associated trigger pulse source.

Figure 6:
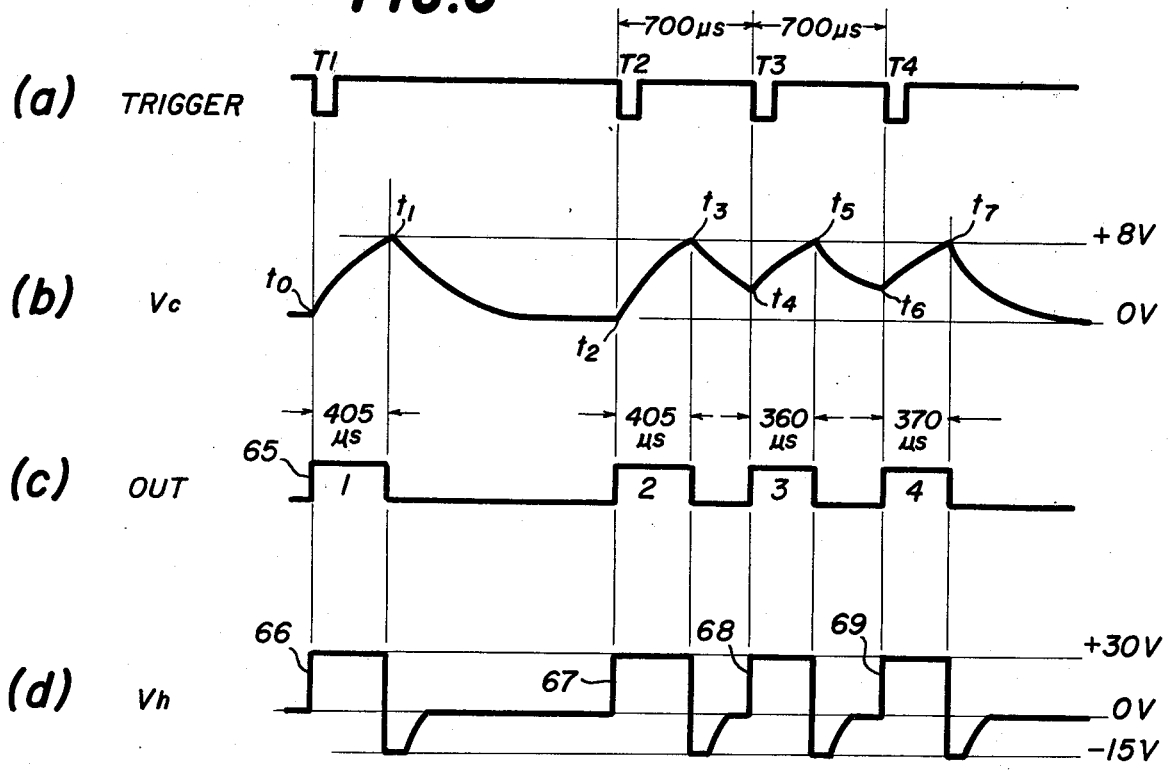
FIGS. 6(*a*)–6(*d*) are voltage waveforms at various portions of the circuit of FIG. 5.

Referring now also to FIGS. 6(*a*)–6(*d*) of the drawings, the operation of the drive circuit 50 will be described. FIG. 6(*a*) illustrates the waveform of a train of input trigger pulses. FIG. 6(*b*) illustrates the waveform of the voltage $V_c$ across the capacitor 53. FIG. 6(*c*)

illustrates the waveform of the series of output pulses at the output terminal of the timing circuit 60. FIG. 6(*d*) illustrates the waveform of the voltage $V_h$ across the printing head 11.

When the timing circuit 60 is off, the capacitor 53 is held discharged through the resistor 54 and the discharge terminal of the timing circuit 60. No output appears at the output terminal of the timing circuit 60 and the transistor 20 is held off, thereby open-circuiting the printing head 11. When a negative trigger pulse T1 appears at the trigger terminal of the timing circuit 60 from an associated matrix encoder, it turns on the output of the timing circuit 60, thereby applying an output pulse 65 to the base of the transistor 20 for turning it on and energizing the printing head 11. The entire 30 volts of the head power supply is applied across the printing head 11 for the duration of the timing circuit output pulse 65. The turning on of the timing circuit 60 also permits the capacitor 53 to charge through the resistors 56 and 54.

When the voltage $V_c$ of the capacitor 53 reaches a threshold level (approximately +8 VDC) determined by the internal circuitry of the timing circuit 60, the timing circuit 60 turns off at time $t_1$, thereby terminating the output pulse 65 at the output terminal thereof and again open-circuiting the printing head 11. In one embodiment, the time constant of the capacitor 53 and resistors 54 and 56 is such that the output pulse 65 from the timing circuit 60 has a duration of approximately 405 usec.

After the timing circuit 60 is turned off, the capacitor 53 is permitted to discharge through the resistor 54 and the discharge terminal of the timing circuit 60, the time constant of the capacitor 53 and resistor 54 being such that the voltage $V_c$ decays to 0 before the arrival of the next trigger pulse T2, at low print rates. When the next trigger pulse T2 appears, the timing circuit 60 is again turned on for energizing the printing head 11 in the same manner as described above. Thus, at low print rates, a series of drive pulses, each having a width of approximately 405 usec. will be supplied to the printing head 11.

When the printing head 11 is operating at or near its maximum rate, the trigger pulses will be fed to the timing circuit 60 at reduced intervals, in one embodiment, of approximately 700 usec. In this case, considering the trigger pulse T2 as the first of a series of high-rate trigger pulses, the timing circuit 60 will be turned on at time $t_2$, thereby producing an output pulse 67 to turn on the transistor 20 and energize the printing head 11, and permitting the capacitor 53 to charge. At time $t_3$, after approximately 405 usec., the voltage $V_c$ on the capacitor 53 reaches the threshold level and turns off the timing circuit 60 for de-energizing the printing head 11. The capacitor 53 then begins to discharge through the resistor 54, as described above, to the time $t_4$ at which time the next trigger pulse T3 arrives to again turn on the timing circuit 60 and cause the capacitor 53 to again begin charging through the resistors 54 and 56.

However, at the time $t_4$ the voltage $V_c$ has not had time to decay to zero, therefore, the recharging of the capacitor 53 begins at a positive voltage level and will, therefore, reach the predetermined threshold level sooner than it did in response to the trigger pulse T2. Thus, after approximately 360 usec. in one embodiment, the voltage $V_c$ reaches the threshold level and turns off the timing circuit 60, thereby terminating the drive pulse 68 to the printing head 11.

Similarly, the voltage $V_c$ decays from time $t_5$ to time $t_6$ at which time the next trigger pulse T4 arrives, before the voltage $V_c$ has decayed to zero. Thus, capacitor 53 again begins recharging from a positive voltage level to the time $t_7$ at which the threshold level is reached for turning off the timing circuit 60, in one embodiment, after about 370 usec., thereby terminating the drive pulse 69 to the printing head 11.

Since the timing circuit 60 is only on from the time it is triggered until the time the voltage $V_c$ across the capacitor 53 reaches the threshold level, the drive pulses applied to the printing head 11 become shorter as the print rate increases, as is apparent from the waveform of the printing head voltage $V_h$. Because these drive pulses all have the same amplitude, the energy delivered thereby to the printing head 11 is proportional to the varying pulse width. But for each drive pulse the total magnetic energy resulting from the addition of the magnetic energy applied by the drive pulse to the residual magnetic energy remaining from the incomplete decay after the preceding drive pulse is always constant. Thus, the printing elements are driven with constant force to produce a constant print intensity, regardless of the variations in the print rate.

It will be noted that since the drive pulse 68 is shorter than the drive pulse 67, the voltage $V_c$ has a slightly longer time to decay between times $t_5$ and $t_6$ than it did between the time $t_3$ and $t_4$, so that it decays to a slightly lower voltage level at the time $t_6$ than at the time $t_4$. Accordingly, it takes slightly longer for the voltage $V_c$ to reach the threshold level in response to the trigger pulse T4, resulting in the drive pulse 69 being slightly wider than the drive pulse 68.

In a constructional model of the drive circuit 50, the circuit elements have the following values: capacitor 53 is 0.01 $\mu$F $\pm$ 2%; resistor 54 is 16.9K ohms $\pm$ 1%; resistor 56 is 20.0K ohms $\pm$ 1%; resistor 61 is 330 ohms. The timing circuit 60 is an MC1555/MC1455 integrated circuit manufactured by Motorola, Inc.

It will be appreciated that for the drive circuit 50, the initial drive pulse of a series of drive pulses will have the same maximum width regardless of the print rate. For low print rates the succeeding drive pulses in the series will also all have the same width as the initial pulse, but for high print rates the succeeding drive pulses will have smaller widths than the initial pulse. Referring to FIG. 7 of the drawings, the width of the initial drive pulse of a series of drive pulses is indicated by the line 70. It can be seen that this width remains constant at approximately 405 usec. in one embodiment, regardless of the pulse repetition interval. Line 75 represents the plot of the width of the fourth pulse of a series of drive pulses and illustrates the manner in which the width of that pulse decreases as the pulse repetition interval decreases with higher print rates.

It can be seen from this graph that for pulse repetition intervals above 1300 usec., corresponding to a pulse frequency of about 770 Hz., the fourth pulse of the series is virtually the same width as the first. At pulse repetition intervals between 1300 usec. and 1,000 usec. (corresponding to a pulse frequency of 1,000 Hz.), the fourth pulse of the series is very slightly narrower than the first pulse, this difference in width representing the residual energy remaining in the print head between drive pulses which, in the prior art printers, would cause a slight but not noticeable variation in print intensity. But at pulse frequencies greater than 1,000 Hz. the difference in width between the first and fourth pulses becomes significant and, therefore, the time constants of the print rate compensation networks 15 and 55 are preferably selected so that the voltages on the capacitors thereof decay to 0 only at print rates less than 1,000 Hz.

While there have been described certain embodiments of the invention, it will be understood that various modifications may be made therein, and it is intended to cover in the appended claims all such modifications as fall within the true spirit and scope of the invention.

What we claim as new and desire to secure by Letters Patent of the United States is:

1. A drive circuit responsive to a series of input pulses to provide drive pulses for the print wires of a printing head of a matrix printer, said drive circuit comprising control means in circuit with a source of electrical energy and the printing head, control means responsive to said input pulses for providing corresponding drive pulses to said printing head, means for insuring that said drive pulses applied to said head result in said print wires producing constant impact forces over a wide range of printing rates comprising circuit means responsive to the time interval between successive input pulses being less than a predetermined value for reducing the energy of the drive pulses provided to said printing head by an amount which varies as a function of said time interval.

2. A drive circuit according to claim 1, wherein said circuit means decreases the amplitude of the drive pulses.

3. The drive circuit of claim 1, wherein said circuit means decreases the time duration of the drive pulses.

4. In combination, a matrix printer for operation with a source of data comprising a print head adapted to traverse a line along a record medium, said head comprising a plurality of print styli adapted to be selectively impacted against said record medium during such traverse, electromagnetic actuating means for imparting printing energy to respective ones of said styli, circuit means coupled to said source of data to selectively apply energy pulses to said actuating means in accordance with the presence of particular data to be recorded, and means for insuring uniform print quality over a wide range of print styli impact rates comprising means to reduce the energy of said applied energy pulses by an amount which varies as a function of the time interval between successive actuations of said actuating means.

5. A drive circuit responsive to a series of input pulses to provide drive pulses for the printing head of a dot matrix printer, said drive circuit comprising electronic switching means in series with a DC supply voltage and the printing head and having opened and closed conditions, said electronic switching means being alternately closed and opened respectively to couple and to decouple the supply voltage from the printing head so as to furnish a series of drive pulses therefor, and circuit means responsive to the frequency of the input pulses exceeding a predetermined value for reducing the energy of the drive pulses in accordance with the amount by which such value is exceeded.

6. The drive circuit of claim 5, wherein said circuit means is coupled in series with said electronic switching means and the DC supply voltage and the printing head.

7. The drive circuit of claim 5, wherein said circuit means is coupled to said electronic switching means, and the input pulses are applied to said circuit means.

8. The drive circuit of claim 5, wherein said circuit means decreases the amplitude of the drive pulses in accordance with the amount by which said predetermined value is exceeded.

9. The drive circuit of claim 5, wherein said circuit means decreases the duration of the drive pulses in accordance with the amount by which said predetermined value is exceeded.

10. The drive circuit of claim 5, wherein said circuit means includes resistance means and capacitance means coupled in parallel, said circuit means being coupled in series with said electronic switching means and the DC supply voltage and the printing head, the input pulses being coupled to said electronic switching means.

11. The drive circuit of claim 5, wherein said circuit means is a pulse generator which has an output coupled to said electronic switching means and an input coupled to receive the input pulses, said pulse generator including timing means responsive to the frequency of the input pulses exceeding a predetermined value to decrease the duration of the pulses produced by said pulse generator in accordance with the amount by which such value is exceeded.

12. A drive circuit responsive to a series of input pulses to provide drive pulses for the print wires of a printing head of a matrix printer, said drive circuit comprising control means in circuit with a source of electrical energy in the printing head, control means responsive to said input pulses for providing corresponding drive pulses to said printing head, means for insuring that said drive pulses applied to said head result in said print wires producing constant impact forces over a wide range of printing rates comprising circuit means responsive to the time interval between successive input pulses being greater than a predetermined value within said range for maintaining the electrical energy of said drive pulses constant, and to the time interval between successive impulses being less than a predetermined value within said range for reducing the electrical energy of said drive pulses provided to said print head from said constant value by an amount which varies as a function of said time interval.

13. In combination a plurality of printing elements, a source of individual drive pulses for actuating respective ones of said elements to print multiple element matrix symbols by impact printing, means for insuring that said drive pulses result in said printing elements producing constant impact forces over a wide range of printing rates comprising means for individually modifying the energy of the drive pulses actuating individual ones of said printing elements by an amount which varies as a function of the frequency of such last named drive pulses.

* * * * *